United States Patent [19]

Tanaka

[11] 4,273,368

[45] Jun. 16, 1981

[54] DUAL LATCHING MECHANISM FOR A FLEXIBLE DECK LID

[75] Inventor: Akira Tanaka, Northridge, Calif.

[73] Assignee: American Safety Equipment Corporaion, San Fernando, Calif.

[21] Appl. No.: 55,183

[22] Filed: Jul. 6, 1979

[51] Int. Cl.[3] ..... E05C 3/26; E05C 9/00

[52] U.S. Cl. ..... 292/53; 292/48; 292/DIG. 14; 292/DIG. 43

[58] Field of Search ..... 292/53, 47, 48, 26, 292/30, 3, 11, DIG. 42, DIG. 43, DIG. 14

[56] References Cited

U.S. PATENT DOCUMENTS

| | | | |
|---|---|---|---|
| 2,285,301 | 6/1942 | Nelson | 292/DIG. 14 X |
| 2,450,357 | 9/1948 | Roethel | 292/11 X |
| 2,608,428 | 8/1952 | Allen | 292/DIG. 43 X |
| 2,839,912 | 6/1958 | Corbin et al. | 292/53 X |
| 2,926,943 | 3/1960 | Leslie et al. | 292/53 |
| 3,961,504 | 6/1976 | Sprecher | 292/DIG. 43 X |

FOREIGN PATENT DOCUMENTS

| | | | |
|---|---|---|---|
| 61425 | 5/1913 | Austria | 292/48 |

*Primary Examiner*—William E. Lyddane
*Attorney, Agent, or Firm*—Poms, Smith, Lande & Rose

[57] ABSTRACT

A dual latching mechanism is provided for latching two spaced locations of a flexible lid to a pair of similarly spaced anchors of a compartment to which the flexible lid is movably mounted. The latching mechanism has two latches mounted on the lid by housings each including a pawl pivotally mounted which is spring biased for movement, when released, to an anchor release position and a blocking dog which is spring biased to a pawl blocking position for locking the pawl to its respective anchor. The latches are interconnected by a latch control which includes two rigid links each link having its outer end connected pivotally to a blocking dog and each having its inner end connected by way of an actuator pin to a key operated lock cylinder which is mounted on the flexible lid. The rigid links are connected so as to maintain axial rigidity for operating the two latches concurrently while having the required flexibility necessary to operate two latches on a flexible lid.

13 Claims, 6 Drawing Figures

DUAL LATCHING MECHANISM FOR A FLEXIBLE DECK LID

BACKGROUND OF THE INVENTION

The present invention relates generally to latching means for securing vehicle deck lids. More particularly, the present invention relates to latching of flexible deck lids. With the present emphasis on lighter weight cars with better fuel economy, many automobile manufacturers have been replacing metal parts on the automobile with lightweight plastic parts. Such an item considered for replacement is the rear trunk lid. In addition, the front engine compartment lid has been considered for replacement by the lightweight plastic materials.

A major problem has arisen, however, in that the conventional centrally located single latch does not prevent the rear corners of a flexible rear trunk lid from being easily distorted allowing unwanted entry into the locked trunk. In order to secure the rear corners of the rear flexible trunk lid, it is necessary to place a latch in each corner. For ease of operation, it would be beneficial to have one centrally located means for operating both latches simultaneously. This is especially critical in flexible deck lids since the inherent flexibility of the lid allows one latch to be in a latching position relative to the compartment anchors while the other latch is still displaced away from its respective compartment anchor resulting in one latch locking while the other latch is still disengaged from its respective compartment anchor. In addition, the centrally located actuating means must be rigid enough to positively operate the latches while at the same time being flexible enough to operate while the lid is being flexed during normal use.

SUMMARY OF THE INVENTION AND ITS OBJECTIVES

Accordingly, it is an object of the present invention to provide a means for latching a flexible deck lid in a manner to prevent flexible distortion of the rear lid corners allowing unwanted entry.

It is another objective of the present invention to provide a dual latching mechanism which allows only concurrent latching of the latches to their respective compartment anchors, whereby independent latching of either one of the latches is prevented.

A further object of the present invention is to provide a dual latch mechanism for a flexible deck lid which is centrally controlled by a single manually operable latch control device.

An additional object of the present invention is to provide a latch control means which is sufficiently rigid to operate both latches concurrently while being designed in a manner to allow normal operation while the flexible deck lid is being flexed.

These objects are achieved in accordance with the present invention by the provision of a dual latching mechanism having two latches for latching two spaced locations of a flexible lid to a pair of similarly spaced anchors of a compartment to which the lid is movably mounted, the two latches being mounted on the interior of the flexible lid by way of mounting housing. Provision is made for the concurrent only latching of the two latching means by way of a centrally located latch control connected between the two latches whereby independent latching of either one of the two latches to its respective compartment anchor is prevented.

These and further objects and various advantages of the invention will become apparent to those skilled in the art from a consideration of the following detailed description of an exemplary embodiment thereof. Reference will be made to the appended sheets of drawings which will first be discussed briefly.

DETAILED DESCRIPTION OF THE PREFERRED EMBODIMENT

Figures 1, 2, 3, 4:
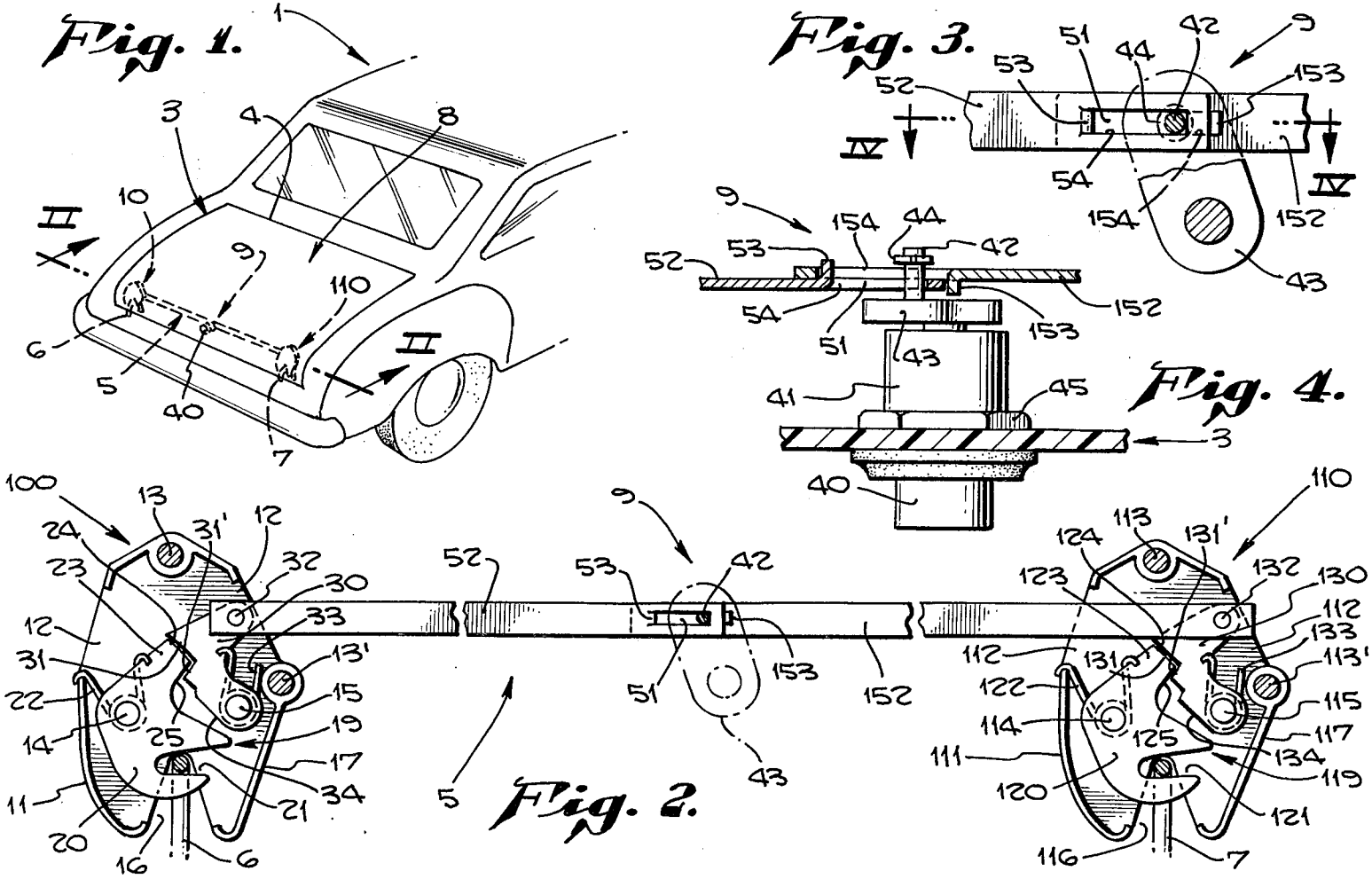
FIG. 1 is a perspective view showing an automobile having a rear trunk lid with a preferred embodiment of the dual latch mechanism of this invention attached thereto and secured to compartment anchors.
FIG. 2 is a detailed view of the dual latch mechanism of FIG. 1 taken in the plane II—II of FIG. 1 showing the two latching means connected centrally to the latch control means and each latching means mounted on its respective mounting means.
FIG. 3 is a more detailed view of the central portion of FIG. 2.
FIG. 4 is a view taken in the plane IV—IV of FIG. 3.

Referring first to FIG. 1, an automobile is shown generally at 1 having a rear deck lid 3 movably mounted as at 4 to the rear compartment shown generally at 8 and secured by the preferred embodiment of the dual latching mechanism of this invention shown generally at 5 to anchors 6, 7 mounted to the interior of the rear compartment 8. The dual latching mechanism 5 is shown comprising a first and second latching means 10, 110 and latch control means shown generally at 9 connected between the first and second latching means 10, 110 for providing concurrent latching only of the dual latching mechanism 5. Although the first and second latching means 10, 110 are shown mounted on the rear deck lid 3 and the anchors 6, 7 are shown mounted to the interior of the rear compartment 8, their mounting locations could be reversed.

A preferred exemplary embodiment of the dual latching mechanism 5 is shown in FIG. 2 wherein mounting means such as housings 11, 111 having flanged edges 17, 117 for spacing the housing 11, 111 away from the lid 3 while also providing protection for the latching means 19, 119 mounted therein are provided for mounting latching means such as those shown generally at 19, 119 to the rear deck lid 3 with the two latching means 19, 119 being interconnected by an exemplary latch control means 9. The housings 11, 111 are provided with a plurality of bolt receiving apertures having bolts 13, 13' and 14 shown for securing housing 11 to the rear deck lid 3 and bolts 113, 113' and 114 shown for securing housing 111 to the rear deck lid 3. The housings 11, 111 are also slotted as at 16, 116 for allowing the anchors 6, 7 free movement into the latching means 19, 119 for engagement with the latching means 19, 119. In addition, the housings 11, 111 have apertures 12, 112 through the flange edges 17, 117 for allowing passage of the latch control means 9 therethrough for its connection between the latching means 19, 119 contained within the housings 11, 111.

Figure 6:
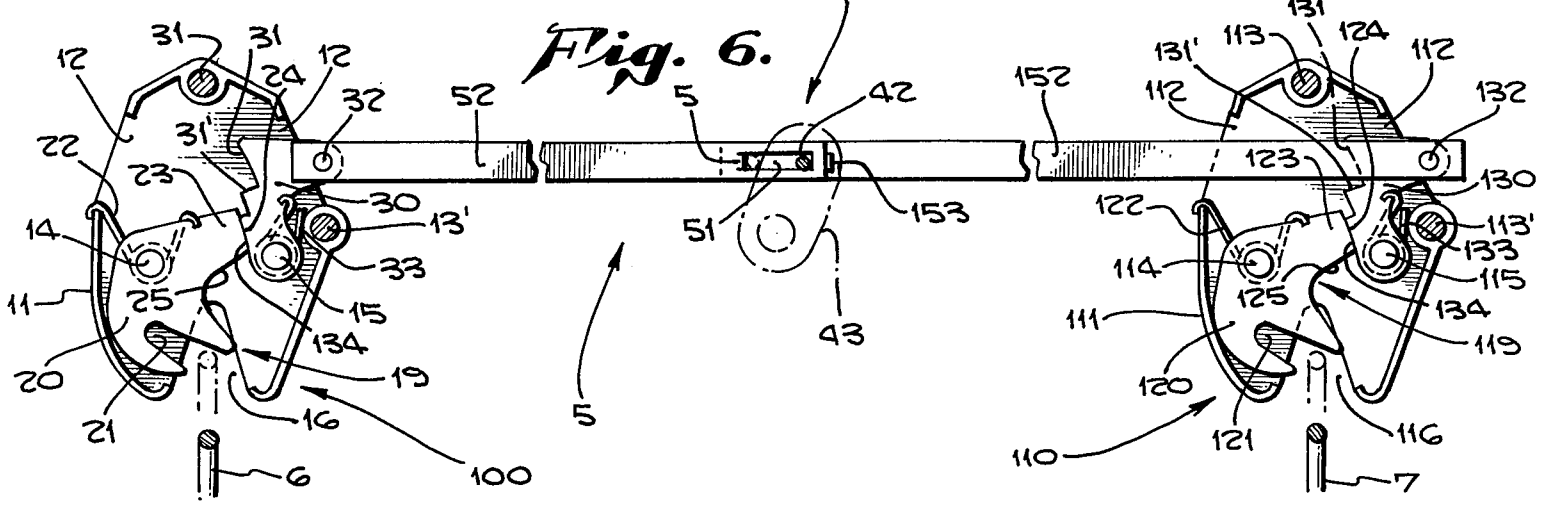
FIG. 6 is also a detailed view of the dual latch mechanism of FIG. 1 taken in the plane II—II of FIG. 1 showing both latching means in the released position.

The latching means 19, 119 are identically composed of two major elements, those elements being pawls 20, 120 and blocking dogs 30, 130. Pawls 20, 120 are pivotally mounted on the housings 11, 111 as at 14, 114 for movement between anchor engaging and anchor release positions as shown in FIGS. 2 and 6 respectively. The pawls 20, 120 are biased to the anchor release position as shown in FIG. 6 by biasing means such as springs 22, 122. Blocking dogs 30, 130 are pivotally mounted on the housings 11, 111 as at 15, 115 and are moveable between a pawl blocking position preventing pawl movement out of its anchor engaging position as shown in FIG. 2 and a pawl release position as shown in FIG. 6. The blocking dogs 30, 130 are biased toward a pawl blocking position as shown in FIG. 2 by a biasing means such as springs 33, 133.

The pawls 20, 120 have identical anchor engaging slots 21, 121 for engaging the rear compartment anchors 6, 7. The slots being shaped so that as the pawls 20, 120 moveably contact the anchors 6, 7, the pawls 20, 120 automatically are pivoted to an engaged position as shown in FIG. 2. The pawls 20, 120 are locked in this position by the blocking dogs 30, 130 which are biased to pivot into a blocking position against the blocking dogs contact arms 23, 123 of the pawls 20, 120. The blocking dogs contact arms 23, 123 are provided with end surfaces 24, 124 and side surfaces 25, 125.

In the anchor engaging position, the pawl end surfaces 24, 124 abuts the vertical surfaces 31, 131 of the blocking dogs 30, 130. The abutment between the pawl end surfaces 24, 124 and the vertical surfaces 31, 131 of the blocking dogs prevents the pivoting of the blocking dogs 30, 130 past their pawl blocking positions as shown in FIG. 2.

The pawls 20, 120 are locked in the anchor engaging position by the abutment of the pawl side surfaces 25, 125 with the underlying surfaces 31', 131' of the blocking dogs. When the blocking dogs 30, 130 are pivoted away from the pawls 20, 120, the underlying surfaces 31', 131' slide transversely away from their blocking position against the pawl side surfaces 25, 125. Once the underlying surfaces 31', 131' have been moved away from their blocking position against the pawl side surfaces 25, 125, the pawls 20, 120 are free to be pivoted to their anchor release positions by the biasing springs 22, 122.

This particular configuration of pawls 20, 120 in relation to blocking dogs 30, 130 results in a system wherein a minimal amount of key release effort is required to permit the pawls 20, 120 to move from their anchor engaging position to their anchor release position. The key release effort is the amount of force which must be applied to the rigid links 52, 152 via the key operated lock cylinder 41, in order to pivot the blocking dogs 30, 130 away from their pawl blocking position. The key release effort is minimized in the preferred embodiment of the present invention since the only forces preventing pivoting of the blocking dogs 30, 130 away from their pawl blocking positions are the frictional forces exerted by the pawl side surfaces 25, 125 against the underlying surfaces 31', 131' of the blocking dogs 30, 130 and the biasing force of the springs 33, 133. Any desired level of key release effort may be achieved by simply varying the biasing force of the springs 33, 133 or the frictional force exerted by the pawl side surfaces 25, 125 against the underlying surfaces 31', 131' of the blocking dogs 30, 130. The frictional forces are controlled by varying the biasing force of springs 22, 122. The important point is that no key release effort must be directly applied to the pawls 20, 120 to pivot them from their anchor engaging positions to their anchor release positions.

FIG. 6 shows the pawls 20, 120 in their anchor release positions. The pawls 20, 120 are maintained in the anchor release position by the abutment of the pawl end surfaces 24, 124 against release surfaces 34, 134 on the blocking dogs 30, 130.

Figure 5:
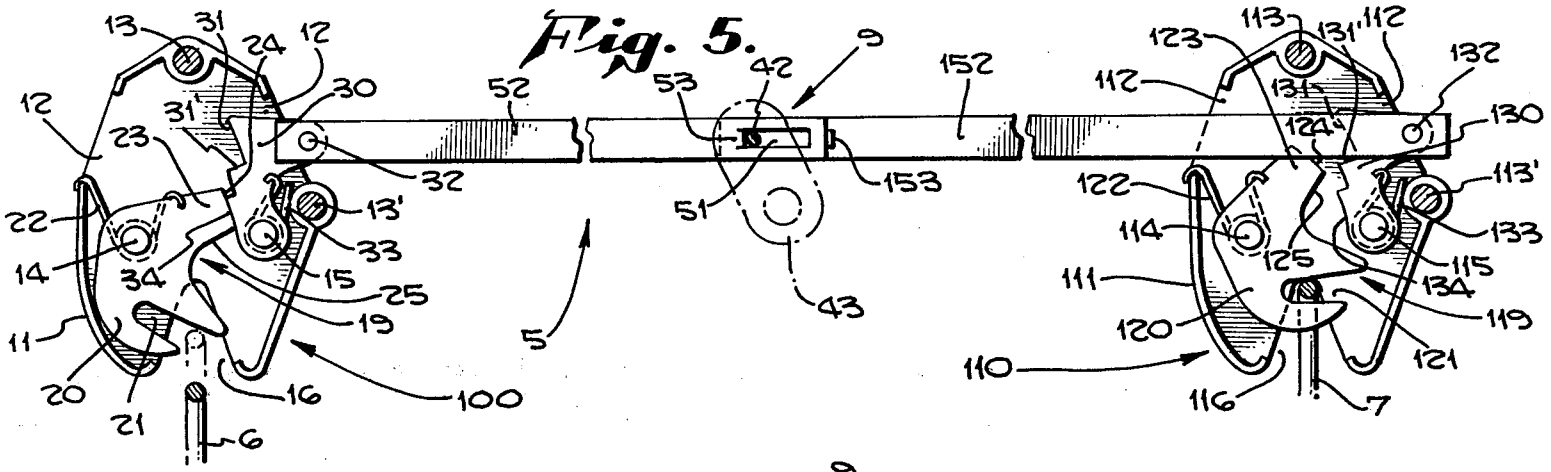
FIG. 5 is a detailed view of the dual latch mechanism of FIG. 1 taken in the plane II—II of FIG. 1 showing the right latching means engaged with its respective anchor and the left latching means being displaced from its respective anchor demonstrating that the right latch is not latched.

FIG. 5 demonstrates how concurrent latching only of the pawls 20, 120 is provided for. Pawl 120 is in an anchor engaging position with floor anchor 7, while pawl 20 is in an anchor release position displaced from floor anchor 6. The pawl end surface 24 is abutting the release surface 34 of the blocking dog 30. Since the two blocking dogs 30, 130 are interconnected rigidly by the rigid links 52, 152, the blocking dog 130 is also in a pawl release position. With the blocking dog 130 being in the pawl release position, the underyling surface 131' cannot abut the pawl side surface 125 to cause locking of the pawl 120 in the anchor engaging position. With the blocking dogs 30, 130 movable to pawl blocking positions and pawl release positions concurrently only, it can be seen that latching or locking and release of the pawls 20, 120 can only be accomplished concurrently.

The latch control means as shown in FIG. 2 generally at 9 comprises a rigid link 52 pivotally attached on one end to the blocking dog 30 as at 32 and another rigid link 152 pivotally connected to blocking dog 130 as at 132 both rigid links 52, 152 being centrally connected to an actuator means 40. Such a connection may be accomplished as shown in FIG. 4 where rigid links 52, 152 have slots 54, 154 defining a pin receiving aperture 51 for movably receiving an actuator pin such as that shown at 42, the actuator pin 42 being eccentrically connected to an operable release means such as a key operated lock cylinder 41 by way of a cam 43. The actuator pin 42 can be retained within the pin receiving aperture 51 by a retaining means such as split ring 44. Cylinder 41 is provided with a key return spring or biasing means to return the pin 42 to the position of FIG. 2. The pin receiving aperture 51 is long enough for permitting the actuator pin 42 to move the blocking dogs 30, 130 to their pawl release position as shown in FIG. 6 and be returned to its original position for allowing key removal with the blocking dogs 30, 130 remaining in the pawl release positions.

To ensure common operation of the blocking dogs 30, 130, the rigid links 52, 152 must be connected in such a manner as to prevent axial relative movement of the links 52, 152 while still allowing relative movement of ends attached to the actuator pin 42 laterally of one another to provide lateral flexibility of a mid portion of the linkage means 9 while maintaining axial rigidity. This may be accomplished as shown in FIG. 4 by the provision of flanges 53, 153, which interlock in apertures 54 and 154.

A means for mounting the key operated lock cylinder 41 is also provided as shown in FIG. 4. The key operated lock cylinder 41 is secured transversely to the rear deck lid 3 by a mounting nut 45 and secured in such a position as to place the actuator pin 42 within the pin receiving aperture 51 whereby manual operation of the key operated lock cylinder 41 operates the rigid links 52, 152 in moving the blocking dogs 30, 130 to the pawl release position as shown in FIG. 6. The linkage means 9 flexes vertically at its interior mid position as the actuator pin 42 moves through an arcuate path.

It is understood that the present invention has been disclosed by reference to a particular and preferred embodiment thereof, and modifications and design changes may be made to the disclosed embodiment without departing from the scope of the invention.

I claim:

1. A dual latching mechanism for latching two spaced locations of a flexible lid to a pair of similarly spaced anchors of a compartment to which said lid is movably mounted, said latching mechanism comprising:

first and second latching means for latching to said anchors said first and second latching means being individually actuated to latching positions by each striking said anchors;

mounting means for mounting said latching means to said flexible lid at spaced locations thereon; and latch control means connected between said first and second latching means for allowing independent movement of said latching means to said latching position while limiting latching action of said latching means to concurrent only latching to said sanchors, whereby independent latching of either one of said latching means to one only of said anchors is prevented.

2. The dual latching mechanism of claim 1 wherein each of said latching means comprises:

a pivotally mounted pawl movable between anchor engaging and anchor release positions;

biasing means for biasing said pawl to anchor release position; and a pivotally mounted blocking dog movable between a pawl blocking position preventing pawl movement out of its anchor engaging position and a pawl release position.

3. The dual latching mechanism of claim 2 wherein said blocking dog has an underlying surface for preventing movement of said pawl to said anchor release position except when said underlying surface is slidably moved away from said pawl.

4. The dual latching mechanism of claim 3 wherein said blocking dog has a vertical surface for abuttingly engaging said pawl to restrict rotatable movement of said blocking dog, said pawl having end surface means for abuttingly engaging said vertical surface.

5. The dual latching mechanism of claim 3 wherein said pawl has a side surface for contacting said underlying surface, wherein said side surface is shaped so as to permit slidable movement of said underlying surface away from said side surface.

6. The dual latching mechanism of claim 2 wherein said latch control means comprises:

linkage means connected between the blocking dogs of said first and second latching means for limiting said blocking dogs to concurrent movement between their respective pawl blocking and pawl release positions.

7. The dual latching mechanism of claim 6 wherein said linkage means comprises:

a first rigid link pivotally connected at an outer end to one of said dogs;

a second rigid link pivotally connected at an outer end to the other of said dogs; and means for connecting inner ends of said links to one another in a manner preventing axial relative movement of said links while allowing relative movement of said inner ends laterally of one another to provide lateral flexibility of a mid portion of said linkage means while maintaining axial rigidity of said links.

8. The dual latching mechanism of claim 7 wherein manually operable release means are provided for moving said dogs to their respective pawl release positions, said release means comprising a manually operable actuator engaging said linkage means.

9. The dual latching mechanism of claim 8 wherein:

said linkage means includes an actuator pin receiving aperture in said linkage means adjacent said inner ends of said links were said links are laterally movable relative to one another;

said manually operable means comprises a key operated lock cylinder having a rotatable and eccentrically mounted actuator pin; and means are provided for mounting said lock cylinder to said flexible lid relative said linkage means to place said actuator pin in said pin receiving aperture of said linkage means, whereby manual operation of said key operated lock cylinder operates said linkage means in moving said dogs to said pawl release position.

10. The dual latching mechanism of claim 9 wherein:

biasing means are provided in association with said key operated lock cylinder for biasing said linkage means through the engagement of said actuator pin with said pin receiving aperture to bias said blocking dogs toward pawl blocking position.

11. The dual latching mechanism of claim 1 wherein said mounting means for mounting said first and second latching means on said lid comprises:

first and second housing means for substantially enclosing and mounting said first and second latching means to an interior surface of said flexible lid relative said compartment with side apertures in each of said housing means for passage of said latch control means therethrough for its connection between said first and second latching means contained within said housing means.

12. A dual latching lightweight closure for a vehicle trunk compartment or the like comprising:

a lightweight plastic material flexible trunk lid pivotally mounted to said trunk compartment and having a pair of latch mounting means on an interior surface thereof in spaced relation;

a pair of anchor means in said compartment in spaced relation to be aligned to said pair of latch mounting means, respectively, when said lid is closed;

a pair of latching means for latching to said anchor means, each of said latching means being mounted to the interior of said flexible trunk lid by one of said latch mounting means to latch to one of said anchor means on closing of said lid wherein each said latching means is moved independently to a position for latching by striking said anchors; and latch control means connected between said pair of latching means for allowing independent movement of said latching means to said position for latching and for controlling the latching thereof to only concurrent latching whereby independent latching of one only of said pair of latching means is prevented.

13. A dual latching mechanism for use in combination with a flexible lightweight plastic trunk lid for an automobile trunk compartment or the like and a pair of lid anchors positioned in said compartment, said mechanism comprising:

first and second latching means for individually engaging and latching to said anchors said first and second latching means being actuated individually and independently to a position for latching by striking said anchors; and latch control means connected between said first and second latching means for allowing independent movement of said latching means to said position for latching and for controlling the latching thereof to only concurrent latching of said first and second latching means to said anchors whereby independent latching of either one of said latching means to one only of said anchors is prevented.

* * * * *